US008408335B2

(12) United States Patent
Rushton

(10) Patent No.: US 8,408,335 B2
(45) Date of Patent: Apr. 2, 2013

(54) DRILL STRING WITH MODULAR MOTOR UNITS

(75) Inventor: Guy James Rushton, Malmesbury (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 374 days.

(21) Appl. No.: 12/315,474

(22) Filed: Dec. 3, 2008

(65) Prior Publication Data

US 2010/0133011 A1 Jun. 3, 2010

(51) Int. Cl.
*E21B 4/16* (2006.01)

(52) U.S. Cl. ..... 175/95; 175/92; 175/107

(58) Field of Classification Search ..... 175/73, 175/95, 107, 92, 57
See application file for complete search history.

(56) References Cited

U.S. PATENT DOCUMENTS 4,011,917 A * 3/1977 Tiraspolsky et al. ..... 175/107
4,227,584 A * 10/1980 Driver ..... 175/95
4,585,401 A 4/1986 Baldenko et al.
4,705,117 A * 11/1987 Warren et al. ..... 175/65
2005/0199423 A1* 9/2005 Moriarty ..... 175/7
2006/0243492 A1* 11/2006 Downton ..... 175/107
2010/0129223 A1* 5/2010 Benito Santiago et al. ... 416/174

FOREIGN PATENT DOCUMENTS

GB 2080367 A 2/1982
GB 2084697 A 4/1982

OTHER PUBLICATIONS

International Search Report and Written Opinion of PCT Application No. PCT/GB2009/002797 dated Jul. 20, 2010.
International Preliminary Report on Patentability of PCT Application No. PCT/GB2009/002797 dated Jun. 16, 2011.

* cited by examiner

*Primary Examiner* — Brad Harcourt
(74) *Attorney, Agent, or Firm* — Robert A. Van Someren; Jeremy Welch; Kimberly Ballew

(57) ABSTRACT

A turbine for use in a downhole drill string including an elongated casing defining an interior and a plurality of motor units in the interior. Each motor unit has a rotor and a stator. A torque transmission couplings connects each of the plurality of motor units to the drill string. The torque transmission couplings having flexible linkages. As a result, the power section has tight tolerances for the clearance at the tips of the rotors because the motor units are relatively stiff. The flexing normally obtained by bending the rotor shaft is accomplished and absorbed in the flexible linkages.

21 Claims, 2 Drawing Sheets

DRILL STRING WITH MODULAR MOTOR UNITS

BACKGROUND OF THE DISCLOSURE

1. Field of the Disclosure

The subject disclosure relates to drilling turbines, and more particularly to an improved steerable drilling turbine having modular components.

2. Background of the Related Art

In oil exploration, drilling is an established method of creating a bore-hole through the earth. Many drilling machines are turbines powered by a turbine blade system. Impulse type drilling turbines are driven by a fluid at atmospheric pressure, while reaction type drilling turbines are driven by fluid pressurised to above atmospheric pressure, possessing energy which is partly kinetic and partly pressure. Drilling turbines are often preferred because of the ability to be successfully deployed in steerable drilling applications.

In drilling turbine applications, the drilling turbine is used to transfer the hydraulic power of a drilling fluid being pumped through the drilling turbine into rotational power of a rotor element, which is rigidly attached to a drive shaft system. Ultimately, the drive shaft system is connected to a drilling bit for the explicit purpose of boring through the earth's structure such as rock. The hydraulic fluid is often referred to a drilling mud. The typical drilling turbine is configured as a 20-30 foot long pair of matching helixes with one helix being the stator and one helix being the rotor.

Despite many advances, there are problems associated with turbine drilling. For example, turbine life can be undesirably short due to the abrasive drilling mud and damage from larger particles in the mud flow. Traditionally, once a portion of the turbine is worn out, the entire turbine assembly is replaced. Such a replacement is a costly approach.

The conventional drilling turbine also has low efficiency, e.g., 40%, because of the large tip clearances that are required. The tip clearance is needed to allow for shocks and bending of the rotor/stator assembly that are normal during operation. Further, as the drilling turbines are run at high speed, sealed oil bearings are used. Despite being sealed, it is difficult to prevent ingress of mud and other contaminants that reduce bearing speed, effectiveness and life.

Traditional drilling turbines also use a reduction gearbox that is oil lubricated. The reduction gearbox brings the relatively high working speed of the turbine down to a suitable speed for the cutting tools. This reduction gearbox suffers from similar sealing issues with respect to mud and contaminants as the sealed bearings.

SUMMARY OF THE INVENTION

In view of the above, there is a need for an improved modular drilling turbine which reduces abrasive wear to increase life, allows for minimal part replacement to conserve cost, establishes tight tolerances to increase efficiency, and/or alleviates strain on seals.

The subject technology is directed to a turbine for use in a downhole drill string including an elongated casing defining an interior and a plurality of motor units in the interior. Each motor unit has a rotor and a stator. Torque transmission couplings connect each of the plurality of motor units to the drive shaft. The torque transmission couplings having flexible linkages. As a result, the power sections have tight tolerances for the clearance at the tips of the rotors because the motor units are relatively stiff. The flexing normally obtained by bending the rotor shaft is accomplished and absorbed in the flexible linkages.

Preferably, the casing is generally tubular and defines an axial fixing groove, and the motor units are keyed to the axial fixing groove for limiting rotational movement of the motor units. Each motor unit is self-contained and has a sealed bearing for supporting movement of the rotor. The bearings are sealed by chambers having magneto-rheological fluid. Each motor unit includes a reservoir of pressurized oil for lubricating the bearing. A membrane surrounds the oil reservoir to facilitate pressurizing the oil by using the pressure of the drilling mud acting on the membrane.

Still another embodiment of the subject technology includes a turbine for use in a downhole drill string including an elongated tubular casing defining an interior and an axial fixing groove. There are at least two motor units in the interior with a rotor and a stator, wherein the motor units are keyed to the axial fixing groove. A bearing in each motor unit supports movement of the rotor. A membrane creates a pressurized oil reservoir around each bearing for lubrication. A torque transmission coupling having flexible linkages extends between the motor units. Preferably, the turbine further includes a shroud formed about the top of the rotor of each motor unit. Each shroud may include a sealing assembly.

The subject technology is also directed to a method for downhole drilling including the steps of providing two turbine motor units for use in a downhole drill string, each motor unit having a rotor and a stator, surrounding the two turbine motor units with an elongated tubular casing, supporting movement of each rotor with a bearing, surrounding each bearing with a membrane, the membrane having pressurized magneto-rheological fluid therein, and coupling the two motor units together with flexible linkages.

The method may further include the step of attaching the motor units to the casing by using a method selected from the group consisting of: forming an axial groove in the casing and a mating protrusion on the motor units; engaging an interference fit between the motor units and casing; applying an adhesive between the motor units and casing; passing a setscrew through the casing to engage a motor unit; and combinations thereof. The method may also include the steps of forming a shroud about each motor unit and/or applying a coating on at least one of the rotor and stator. In one embodiment, the method also includes the step of transmitting a rotational energy output of the two turbine motor units to a device for harnessing the output, the harnessing device being selected from the group consisting of a drilling tool, an alternator, a generator, and combinations thereof.

Still another embodiment of the subject technology is directed to a turbine for use in a downhole drill string including an elongated casing defining an interior, a plurality of motor units in the interior, each motor unit being attached to the elongated casing, and a torque transmission coupling between each of the plurality of motor units. The motor units may be attached to the casing by a coupling selected from the group consisting of an axial groove with mating protrusion, an interference fit, adhesive, a setscrew and combinations thereof.

It should be appreciated that the present invention can be implemented and utilized in numerous ways, including without limitation as a process, an apparatus, a system, a device, and a method for applications now known and later developed. These and other unique features of the systems and methods disclosed herein will become more readily apparent from the following description and the accompanying drawings.

BRIEF DESCRIPTION OF THE DRAWINGS

So that those having ordinary skill in the art to which the disclosed systems and methods appertain will more readily understand how to make and use the same, reference may be had to the drawings wherein.

DETAILED DESCRIPTION OF PREFERRED EMBODIMENTS

Figure 1:
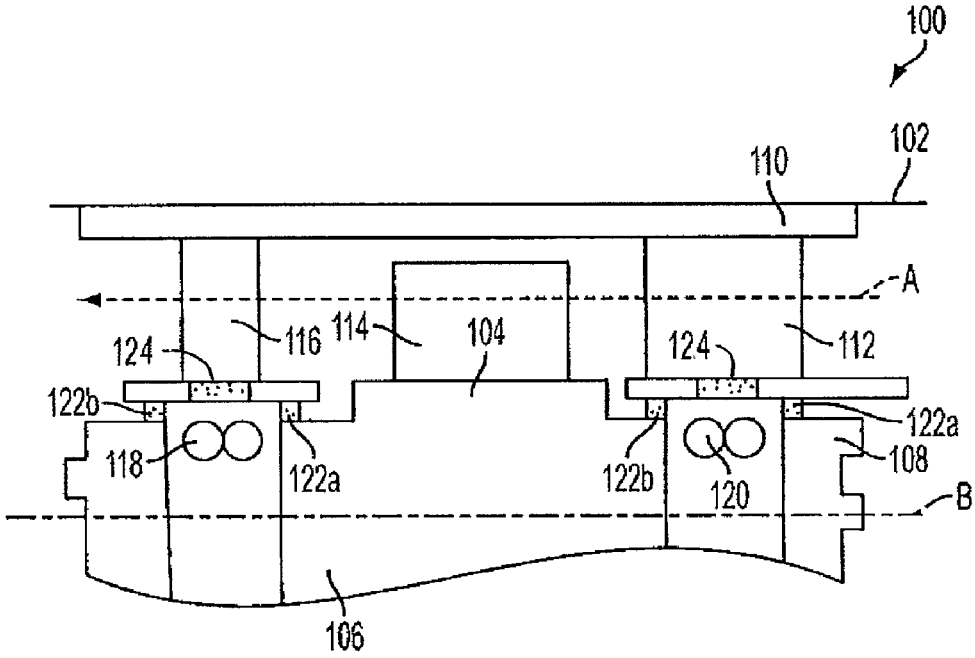
FIG. 1 is schematic representation of a turbine module in accordance with the subject technology.

The present disclosure overcomes many of the prior art problems associated with downhole drill strings. The advantages, and other features of the systems and methods disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as trailing, leading, front, rear, left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology.

Referring now to FIG. 1, a schematic representation of a portion of a turbine module 100 in accordance with the subject technology is shown. The turbine module 100 is for use in a downhole drill string 102. Power is generated by the turbine module 100 by a plurality of motor units 104. Although a single motor unit 104 is shown in FIG. 1 for simplicity, a plurality of motor units 104 are used in the drill string 102.

Power is transmitted from motor unit 104 to motor unit 104 through the drive shaft 106. The motor units 104 couple to the drive shaft 106 by a flexible torque transmission joint 108. Thus, the overall power section is relatively flexible to accomplish the bending that would normally occur in the rotor shaft. By having flexing occur in the torque transmission joints 108 intermediate the motor units 104, each motor unit 104 may be relatively stiff. This stiffness also allows tight tolerances for the rotor tip clearances which remain relatively unchanged. Thus, the power section has greater efficiency and, in turn, improved power density.

The plurality of motor units 104 are housed within a respective elongated casing 110. Each motor unit 104 includes at least one row of stator blades 112 and rotor blades 114. The stator blades 112 are connected to the casing 110 and turn the fluid flow, denoted by arrow "A". In contrast, the rotor blades 114 remove the swirl induced by the stator blades 112. As the rotor blades 114 are connected to the drive shaft 106, the result is that the rotor blades 114 impart a rotational energy to the drive shaft 106, which rotates about a central axis identified by dashed line "B".

A strut 116 behind the rotor blades 114 supports a rear bearing 118 of the motor unit 104. Preferably, the strut 116 is a simple aerodynamic fairing that does not turn the fluid flow with the strut 116 arranged so that the associated wake passes into a mid-passage region of the stator blade of the downstream motor unit. At the opposing end of the motor unit 104, the stator blade 112 supports the front bearing 120 of the motor unit 104. Each motor unit 104 is separated sufficiently to reduce or minimize any effects of rotor wake and stator blade interaction.

The stator and rotor blades 112, 114 may be fabricated from an elastomer, a composite, an alloy, powdered metal and combinations thereof. The stator and rotor blades 112, 114 may also have a coating applied thereto. The material selection and coatings may be designed to improve the efficiency, durability and performance of the motor units 104. In one embodiment, the coating is an elastomer on alloy blades. The coating can help to provide abrasion resistance and improve the sealing properties. Of course, the rotor blades 114 and stator blades 112 may not be coated at all and a metal on metal seal may perform adequately in terms of erosion and sealing.

The modular motor units 104 are fixed rotationally within their casing 110 as well. For example, the casing 110 may be generally tubular and define an axial fixing groove (not shown). The motor units 104 are keyed to the axial fixing groove such as by an axial protrusion or the like. The motor units 104 may also be limited rotationally by forming an interference fit between portions of the motor units 104 and casing 110, applying an adhesive between the motor unit components and casing 110, passing a setscrew through the casing 110 to engage motor unit components, and like combinations.

By separating the motor units 104, each motor unit 104 is self-contained or modular so that if one motor unit wears out or otherwise needs to be replaced, only the defective motor unit 104 needs to be replaced. As a result, when each motor unit 104 has a single row of stator and rotor blades 112, 114, only the worn out row can be replaced rather than the entire power section. Additionally, by having modular motor units 104 that can be added or subtracted, the power section may be increased or decreased in the field to match conditions. Similarly, the drill string may be up-rated as better transmission and motor units become available as replacement parts. Further, by standardizing the motor units of the drill string, many more components may be standaradized such as downhole electricity generators, which may also be reused to lessen inventory requirements.

The modular motor units 104 include bearings 118, 120 for supporting movement of the rotor blades 114. The bearings 118, 120 are sealed to prevent mud ingress. In one embodiment, the bearings 118, 120 are sealed by magneto-rheological fluid held in leading and trailing chambers 122*a*, 122*b* that surround the bearings 118, 120. It may be necessary to place baffles (not shown) in front of the magneto-rheological fluid chambers 122*a*, 122*b* to prevent excessive turbulence in the drilling mud from removing the magneto-rheological fluid. By improving the performance of the bearings 118, 120 with sealing, the usable speeds and durability of the motor units 104 are enhanced.

Each motor unit 104 also includes a sealed reservoir of oil for lubricating the bearings 118, 120. Membranes 124 also cover the sealed reservoir of oil, which is pressurized by the drilling fluid acting on the membranes 124. The membranes 124 may be fabricated from a material selected from the group consisting of an elastomeric material, a machined metal material, and combinations thereof. In operation, as the local fluid pressure increases, the membranes 124 deflect and transmit pressure to the oil to insure a substantially neutral pressure differential across the magnetic fluid chambers

122*a*, 122*b*. Although FIG. 1 shows the membranes 124 schematically, it is envisioned that the membranes 124 are placed so that pressure in the oil transmitted by the membranes 124 is close to the pressure acting on the magneto-rheological fluid chambers 122*a*, 122*b*. As shown, the fluid chambers 122*a*, 122*b* are recessed so that the pressure acting on the fluid chambers 122*a*, 122*b* will be close to the static pressure at the respective axial location.

If there is different static pressure at the leading seal chamber 122*a* compared to the trailing seal chamber 122*b*, the turbine module 100 may use two pressure membranes, appropriately located, to match conditions at the faces of the leading and trailing chambers 122*a*, 122*b*. As a result, the magneto-rheological fluid will only be exposed to small pressure differentials, such as below 0.5 bar. It is noted that the pressure differential at the rear bearing 118 may be negligible so that compensation may be less important. Preferably, the chambers 122*a*, 122*b* and membranes 124 may be maintained and replaced before and after the turbine module 100 is assembled and will remain sealed until the respective motor unit 104 is replaced.

The sealing chambers 122*a*, 122*b* and pressurized oil reservoir for the bearings 118, 120 may be equally successfully applied to other applications. For example without limitation, typical drill strings have a reduction gearbox to bring down the relatively high working speed of the turbine module, to a speed suitable for cutting tools. Such reduction gearbox can be accomodated with similar or the same sealing chambers and pressurized oil reservoir for the bearings.

Figure 2:
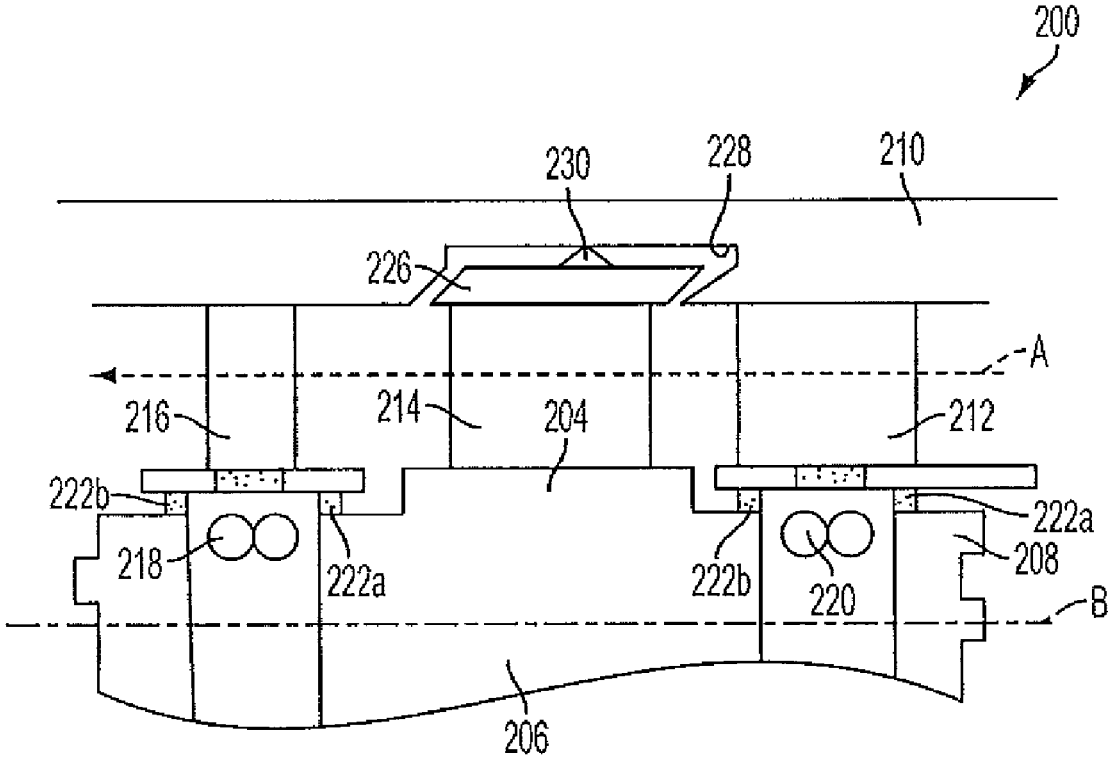
FIG. 2 is schematic representation of another turbine module with a shroud in accordance with the subject technology.

Referring now to FIG. 2, a schematic representation of another portion of a turbine module 200 in accordance with the subject technology is shown. As will be appreciated by those of ordinary skill in the pertinent art, the turbine module 200 utilizes similar principles to the turbine module 100 described above. Accordingly, like reference numerals preceded by the numeral "2" instead of the numeral "1" are used to indicate like elements. The primary difference of the turbine module 200 in comparison to the turbine module 100 is the formation of a shroud 226 on the rotor blades 214 of each motor unit 204.

By incorporating a shroud 226, the turbine module 200 provides an area for tight tip tolerances, performs better under higher pressure differentials, and is more tolerant of debris in the drilling mud. The casing 210 forms an annular recess 228 sized and configured for receiving the shroud 226. Preventing debris from jamming the turbine module 200 is a particularly desirable feature in many circumstances. The casing 210 and the shroud 226 may overlap to further limit passage of debris such as large particles in the drilling mud. In other words, the shroud 226 may extend into the casing 210 as shown in FIG. 2.

Each shroud 226 also includes a sealing assembly 230 for engaging the casing 210. Preferably, the sealing assembly 230 is employed on top of the shroud 226. Conventional seals, such as a labyrinth, brush seal type or other variant, may be used as the sealing assembly 230, which may be contacting or non-contacting.

Although the discussion herein has been with respect to using a turbine module to drive a drilling component, it is also envisioned that such turbine modules may be used to provide rotational energy to a variety of components. Examples of components that harness rotational/torque energy, without limitation, include alternators and/or generators that create electrical power. Further, the turbine modules may include means, such as cabling, for transmitting electrical signals, be it power or data signals, across the drill string. The electrical conducting means may couple across each motor unit and pick up additional information from each motor unit for use in a remote location.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. A turbine for use in a downhole drill string comprising:
- a plurality of elongated casings, each casing defining an interior;
- a motor unit in each interior, the motor unit being a turbine motor unit having a rotor and a stator;
- a torque transmission coupling with flexible linkages for each motor unit, wherein each motor unit has a sealed bearing for supporting movement of the rotor and includes a reservoir of pressurized oil for lubricating the bearing; and
- a first membrane sealing the oil, wherein the oil is pressurized by drilling mud flowing through the motor unit and acting on the membrane while flowing through the motor unit.

2. A turbine as recited in claim 1, wherein the casing is generally tubular and defines an axial fixing groove, and the motor units are keyed to the axial fixing groove for limiting rotational movement of the motor units.

3. A turbine as recited in claim 1, wherein each motor unit is self-contained.

4. A turbine as recited in claim 1, wherein the bearings are sealed by magneto-rheological fluid that surrounds the bearings in chambers.

5. A turbine as recited in claim 1, wherein the first membrane is positioned and configured so that a membrane pressure transmitted thereby is approximately equal to a chamber pressure acting on the magneto-rheological fluid.

6. A turbine as recited in claim 5, further comprising a second membrane sealing the oil, wherein the first and second membranes are positioned and configured to substantially equate pressure at leading and trailing edges of the chambers.

7. A turbine as recited in claim 6, wherein the first and second membranes are fabricated from a material selected from the group consisting of an elastomeric material, a machined metal material, and combinations thereof.

8. A turbine as recited in claim 1, further comprising a shroud formed about each motor unit.

9. A turbine as recited in claim 8, wherein each shroud includes a sealing assembly.

10. A turbine as recited in claim 1, wherein the rotors are fabricated of a material selected from the group consisting of an elastomer, a composite, an alloy, powdered metal and combinations thereof.

11. A turbine as recited in claim 1, wherein the stators are fabricated of a material selected from the group consisting of an elastomer, a composite, an alloy, powdered metal and combinations thereof.

12. A turbine for use in a downhole drill string comprising:
- an elongated tubular casing defining an interior and an axial fixing groove;
- at least two motor units in the interior, each motor unit being a turbine motor unit having a rotor and a stator, wherein the motor units are keyed to the axial fixing groove;

a bearing in each motor unit for supporting movement of the rotor;

a membrane coupled to each bearing for creating a pressurized oil reservoir around each bearing for lubrication, the pressurized oil reservoir being pressurized by drilling mud as it flows through the at least two motor units; and a torque transmission coupling with flexible linkages connecting the motor units to the downhole drill string.

13. A turbine as recited in claim 12, wherein the membrane is fabricated from a material selected from the group consisting of an elastomeric material, a machined metal material, and combinations thereof.

14. A turbine as recited in claim 12, further comprising a shroud formed about each motor unit, wherein each shroud includes a sealing assembly.

15. A turbine as recited in claim 14, wherein the bearings are sealed by magneto-rheological fluid that surrounds the bearings in recessed chambers.

16. A method for downhole drilling comprising the steps of:

providing two turbine motor units for use in a downhole drill string, each motor unit having a rotor and a stator;

surrounding the two turbine motor units with an elongated tubular casing;

supporting movement of each rotor with a bearing;

surrounding each bearing with a membrane containing a magneto-rheological fluid therein;

pressurizing the magneto-rheological fluid within the membrane by applying pressure via drilling mud acting on the membrane as the drilling mud flows through the two turbine motor units; and coupling the two motor units together with flexible linkages.

17. A method as recited in claim 16, further comprising the step of attaching the motor units to the casing by using a method selected from the group consisting of: forming an axial groove in the casing and a mating protrusion on the motor units; engaging an interference fit between the motor units and casing; applying an adhesive between the motor units and casing; passing a setscrew through the casing to engage a motor unit; and combinations thereof.

18. A method as recited in claim 16, further comprising the step of forming a shroud about each motor unit.

19. A method as recited in claim 16, further comprising the step of applying an elastomer coating on at least one of the rotor and stator.

20. A method as recited in claim 16, further comprising the step of transmitting a rotational energy output of the two turbine motor units to a device for harnessing the output selected from the group consisting of a drilling tool, an alternator, a generator, and combinations thereof.

21. A method as recited in claim 16, wherein the membrane is fabricated from a material selected from the group consisting of an elastomeric material, a machined metal material, and combinations thereof.

* * * * *